US005224696A

United States Patent [19]

Kellum, III

[11] Patent Number: 5,224,696

[45] Date of Patent: * Jul. 6, 1993

[54] METHOD OF ROTATING SHEET MATERIAL

[75] Inventor: Wilbur J. Kellum, III, Redmond, Wash.

[73] Assignee: EMF Corporation, Redmond, Wash.

[ * ] Notice: The portion of the term of this patent subsequent to Oct. 15, 2008 has been disclaimed.

[21] Appl. No.: 771,481

[22] Filed: Oct. 4, 1991

Related U.S. Application Data

[62] Division of Ser. No. 354,977, May 19, 1989, Pat. No. 5,056,772.

[51] Int. Cl.[5] ..... B65H 29/20

[52] U.S. Cl. ..... 271/184; 271/225; 271/251

[58] Field of Search ..... 271/184, 185, 225, 251

[56] References Cited

U.S. PATENT DOCUMENTS 2,190,413 2/1940 Davidson ..... 271/251
2,190,416 2/1940 Davidson ..... 271/251
2,190,418 2/1940 Davidson ..... 271/251

*Primary Examiner*—Richard A. Schacher
*Attorney, Agent, or Firm*—David L. Garrison

[57] ABSTRACT

A paper rotation table 15 for use in transporting sheets of paper between paper handling devices while performing a rotation upon each sheet through a predetermined arc so as to present to a receiving paper handling device a leading edge different than the leading edge which emerged from a delivering paper handling device. The paper rotation table 15 has sheet support surface 10, a paper drive 20, a pivot 30, and a registration edge 40. The paper drive 20 further has a drive belt 21, a plurality of primary drive balls 25, and a plurality of secondary drive balls 26, an entry drive ball 23, and a spin drive ball 37. Paper drive 20 may be at an angle "a" to registration edge 40.

8 Claims, 6 Drawing Sheets

FIG. 3
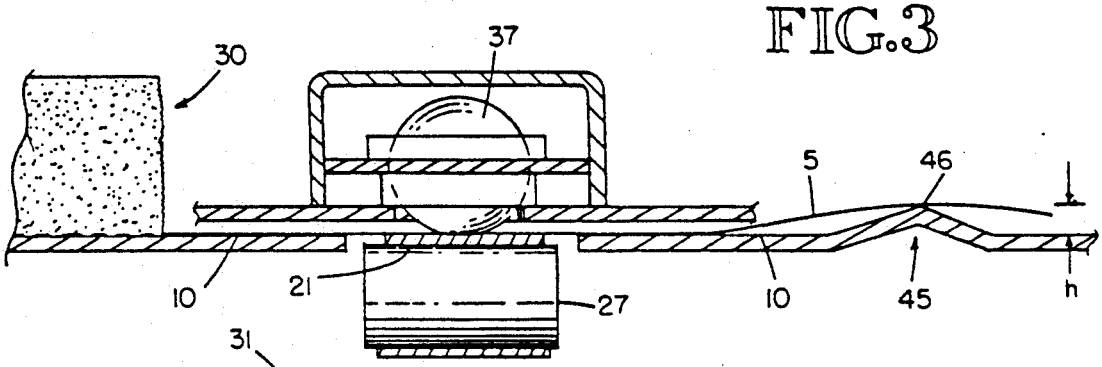
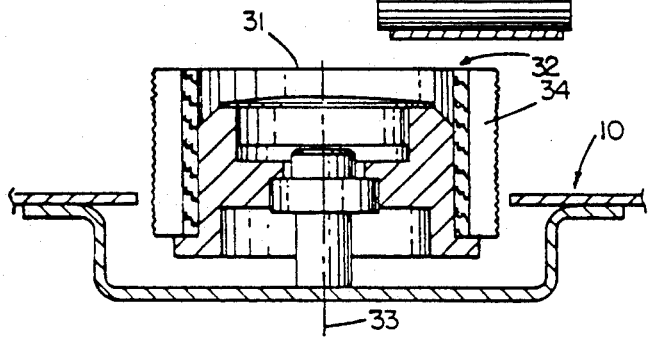
FIG. 4
FIG. 5
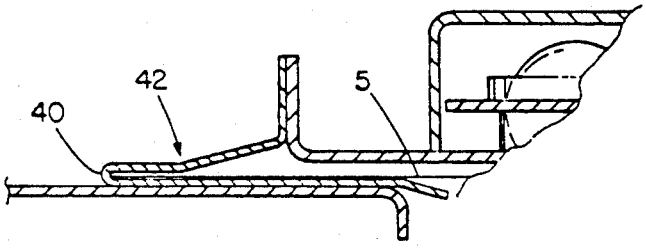
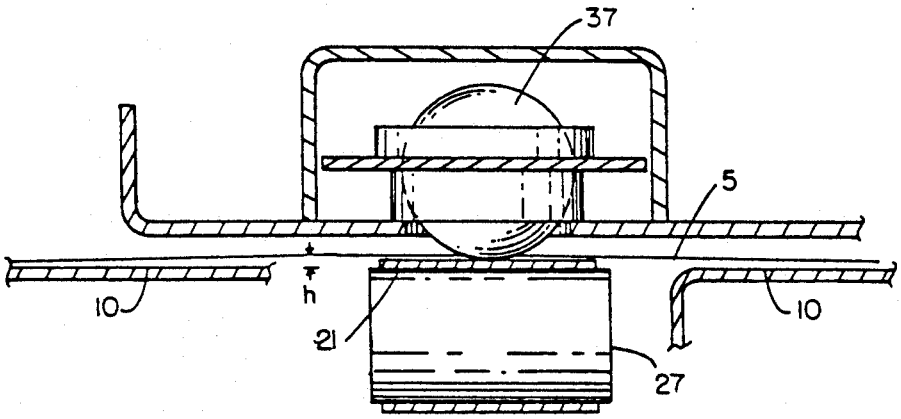
FIG. 6

METHOD OF ROTATING SHEET MATERIAL

This is a divisional of co-pending application Ser. No. 07/354,977, filed on May 19, 1989, now U.S. Pat. No. 5,056,772.

TECHNICAL FIELD

The invention relates to the field of paper sheet handling and transporting devices, and particularly to a method and apparatus for rotating sheets of paper through an arc, usually 90 degrees, as the sheets move between devices in a paper handling system.

BACKGROUND OF THE INVENTION

High speed duplicating and printing devices will typically deliver sheets of paper and other paper-like stock at some exit port on the device with a particular edge of each sheet serving as a leading edge, that is the edge first to leave the device. The range of known duplicating and printing devices, in addition to other paper transporting devices, are known to move and deliver a wide range of sizes and weight of paper stock with a number of different kinds of known inks, fusing oils and the like, in both simplex and duplex modes. Given this variety of paper stock which is delivered at the exit ports of the various devices, there is a corresponding great variation in the beam strength of the various paper stock and in the surface characteristics of the various paper stocks, including nature and quality of print ink, surface finish and texture.

In many paper handling systems it is necessary to transport the paper sheets between various paper handling devices. It often arises in such systems that the leading edge presented by the delivering device is not the optimal sheet edge for purposes of handling within the receiving device. Consequently the need arises for a method and apparatus for rotating each delivered sheet through an arc which is usually ninety degrees so that the leading edge of each sheet presented to the receiving device is not the leading edge which was delivered from the delivering device, but is rather one of the adjacent edges of the typically rectangular sheet. For instance, if sheets are delivered by a duplicating device with their long edges leading, but the receiving sorting device has been optimally set up to receive and sort sheets which are delivered with their short edge leading, each sheet must be rotated through an arc of 90 degrees between when it leaves the duplicating device and when it arrives at the sorting device.

A number of devices have been proposed in the art to the apparent purpose of meeting the above need. However it does not appear that any of the known devices have been functional at all without substantial complexity, resulting in expense of manufacturing and maintenance and unacceptably high breakdown, jamming, and other downtime failure modes. It also does not appear that any of the known devices are capable of receiving and rotating paper stock sheets at the rates at which state of the art high speed duplicating and printing devices are capable of delivering them. This sheet delivery rate is frequently in excess of 170 sheets per minute, and advances in the rapidly changing sheet handling technology will likely soon result in even higher sheet delivery rates. Neither does it appear that any known devices are suitable for, or capable of, receiving, without adjustment, a series of sheets having differing lengths and widths and then rotating each of the sheets, regardless of differing lengths and widths, through a uniform arc smoothly and without damage to the sheets.

There is therefore a need for a method and an apparatus for receiving from one paper handling device, at a high rate of delivery, paper sheets of varying dimensions and stock weight with varying qualities of paper surface characteristics, and with printing on one or both sides of the sheet, and then rotating each of those sheets through the required arc so that they may thereafter be delivered at the same rate of speed from the apparatus to the next paper handling device with the appropriate edge for that device now leading that sheet.

DISCLOSURE OF THE INVENTION

Accordingly it is an object of the invention to provide a method and apparatus for rotating moving paper sheets at a high rate through an arc without damage or deterioration to surface quality or print on the sheet.

It is a further object of the invention to provide a method and apparatus for paper sheet rotating which is compatible with state of the art high speed duplicating and printing equipment, and which can rotate paper sheets smoothly and without damage at rates of speed at least as high as that of the rates of delivery from the high speed devices.

It is another object of the invention to provide method and apparatus for receiving and rotating high speed delivered sheets of paper having various stock weights and beam strengths, and various lengths and widths without requiring adjustment in between these variations.

It is still another object of the invention to provide a method and apparatus which is simple in design and construction, and easy of maintenance, which is durable, and capable of operation at extremely low jam or breakdown rates, and which is adaptable for use between the great variety of paper handling devices now known or hereafter developed.

These and other objects of the invention are accomplished by the means and in the manner hereinafter set forth.

The invention comprises method and apparatus for high speed turning of paper sheet products typically delivered at high speeds by high speed duplicating and printing equipment. The method of the invention comprises the steps of: introducing paper sheets, which are preferably center justified, to a series of weighted driven balls oriented substantially along the centerline of said sheet, so as to direct each sheet along a sheet path; imposing in the sheet path a pivot which is off center with respect to the sheet to cause the sheet to spin around the pivot; catching the spinning sheet with a registration edge and preferably with a second weighted driven ball; and conveying each sheet along the sheet path with additional driven balls whose centers are oriented substantially along a line which may be at an angle to the registration edge. In a preferred embodiment additional steps are added with respect to lighter weighted driven balls just ahead of the first weighted driven ball and just after the pivot, and again at the end of the table to assist in directional control of the driven sheet without substantially interfering with the sheet's ability to be spun around the pivot.

The apparatus of the invention comprises a table which may be either flat or inclined, and which has a sheet supporting surface and a registration edge. In a preferred embodiment the table is inclined at 36–38 degrees to the horizontal, the registration edge is of a folded sheet metal type where the interior edge of the fold forms the registration edge, and the sheet supporting surface creates a height difference of approximately 1/10 of an inch between the surface of a paper drive belt and the rest of the sheet supporting surface. This difference in height is accomplished in preferred embodiments either by raising the belt surface above a substantially planar sheet supporting surface by a distance of 1/10 of an inch or, where a drive belt is employed whose upper, driving surface is substantially coplanar with the sheet supporting surface, creating a raised portion of the sheet supporting surface in the region in which the sheet is to spin around the pivot.

The apparatus also has a pivot and a paper drive. The pivot may be any stationary or rotatably mounted post against which a sheet delivered to the table collides and is spun around by the paper drive. The paper drive is comprised of one or more drive belts, or wheels, upon which roll, under the force of their own gravitational weight, a series of driven balls. The driven balls each exert a gravitationally weighted force against the drive belt in a direction normal to the belt surface which is dependent upon the mass of the weighted ball and upon the angle of inclination of the table. The point of contact between the ball and the drive belt or wheel forms a nip through which the traveling sheet passes. As a sheet enters the nip of the ball and belt, or wheel, the sheet is driven through the nip and thence along the sheet path. A series of driven balls is spaced to serially convey the sheet along the sheet path.

In a preferred embodiment the pivot is rotationally mounted and covered with a removable, resilient, yielding surface to minimize wear to the pivot, or damage to the sheet. Also in a preferred embodiment a single drive belt of approximately one inch in width is employed and multiple drive balls are spaced and aligned along the paper drive in a line which is disposed at a slight angle to the registration edge. In a preferred embodiment this angle is 2 degrees. In a preferred embodiment 20 millimeter stainless steel balls are used as the heavier weighted balls and 20 millimeter plastic balls made of DELRIN® brand polymer are used as the lighter weighted balls. The heavier weighted balls, because of their greater force vector normal to the belt surface, are the predominant driving balls whereas the lighter DELRIN® balls are the secondary balls.

The primary driven balls serve to grip the paper and move it along the sheet path and are selected to have a weight sufficient to grip the paper securely but not great enough to pinch the paper so tightly that it can neither be spun nor slid sideways. The secondary driving balls on the other hand grip the paper only slightly and are not sufficient to interfere significantly with spinning or lateral motions of the sheet as it travels along the path. Thus in a preferred embodiment, the first driven ball which a sheet entering the apparatus encounters is a secondary drive ball because the sheet enters the apparatus still in contact with the drive belt of the delivery source and the paper is thus forced beneath this first secondary driven ball which yields only light resistance to the insertion. The secondary drive ball however serves to guide the paper into the nip of the first primary drive ball which grips the paper more securely and moves the sheet along the drive path to collide with the pivot post, whereupon the inertial force of the traveling paper and the continued driving effect of the primary driven ball causes the paper to spin around the pivot post through an arc of approximately 90 degrees. The first secondary drive ball gives little resistance to this spinning movement. Similarly second and third secondary driven balls positioned downpath in the paper path but within the paper length arc of the spin receive the spinning paper but yield little resistance to its spin. Instead the spin is primarily arrested by the registration edge, while the second and third secondary driven balls serve to lightly or gently guide the paper along the sheet path to the second primary driven ball which then resumes the more forceful urging of the paper down the sheet path along with third and succeeding primary driven balls.

The second primary driven ball is located outside the swing of the longest dimension of the longest sheet to be employed in the apparatus, but only just outside. In a preferred embodiment primary driven balls downstream of the paper pivoting mechanism are spaced so that even with the shortest possible paper being used, at least two balls are always in contact with each sheet. The primary driven balls may be spaced in other embodiments so that at times only one ball is in contact with each sheet; however this can cause overspin of the sheet whenever there is any increased resistance of the paper edge with the registration edge, such as, for instance, when a slight curl develops in the paper edge with respect to the folded registration edge.

It has been found that the weight of the primary driven balls may vary operationally in a range from that of a normal 20 millimeter steel ball up to and including an additional 40 to 100 percent in weight. However even heavier weights will still accomplish the primary functions of the apparatus, with progressively greater risk, however, of jamming and other sheet path malfunctions, and damage to the quality of the printed sheet. Where a substantially flat table is to be employed it is surmised by calculation that a 13/16 inch steel ball will yield an appropriate normal force to the surface of the belt for sheet transport roughly equivalent to that employed in the preferred embodiment. The 40 to 100 percent increase in weight also would apply to the flat embodiment. The preferred DELRIN® polymer balls were selected because they are inert to moisture and other conditions found in sheet handling devices; however nylon, and particularly nylon reinforced with glass fiber, may be employed instead. Conventional nylon will tend to expand and may jam, but it is believed that nylon reinforced with glass will not cause expansion problems. The DELRIN® balls may have a weight range of between 1/5 and 1/7 of the weight of the steel balls in use.

Other embodiments of sheet supporting surfaces may be employed which do not yield a height difference so long as some means of putting a slight cushion of air under the traveling sheet is employed. For instance compressed air jets, where the apparatus is already using compressed air, may be employed to lightly "puff" the paper just above the sheet supporting surface to eliminate the friction which causes problems at spinning time. Where a ridge in the sheet supporting surface is used as the means of creating a height difference, the apex of the ridge should be at or near the edge of 8 to 8½ inch wide paper.

In a preferred embodiment the apparatus is oriented to receive center justified sheets with the centerline of each sheet substantially oriented to travel under the nip of the first secondary and first primary drive balls. It has been found that these driven balls may vary in position with respect to this centerline by +/− 0.3 inches without harmful effect, but it is contemplated that sheets which are not center justified, or whose centerlines vary from the point of contact with the first driven balls by greater than +/− 0.3 inches, may also be employed. Where this greater variance can be expected, or where the sheets are not center justified, the only problem is that sheets are spun with considerable over or under spin, and thereafter require either a greater angle of the line of driven balls to the registration edge and/or a longer registration edge and sheet path to remedy the over or under spin condition.

In a one embodiment a rotatably mounted pivot post is mounted off the centerline of the received sheets with a resiliently surfaced covering cylinder on the pivot post to insulate the post itself from wear. This resilient cover is preferably removable, replaceable, and reversible.

BRIEF DESCRIPTION OF THE DRAWINGS

FIG. 3 is a partial sectional detail taken along line 3—3 in FIG. 1.

FIG. 4 is a partial sectional view taken along line 4—4 in FIG. 1.

FIG. 5 is a partial sectional view taken along line 5—5 in FIG. 1.

FIG. 6 is a partial sectional detail along line 6—6 in FIG. 11.

BEST MODE FOR CARRYING OUT THE INVENTION

Figure 1:
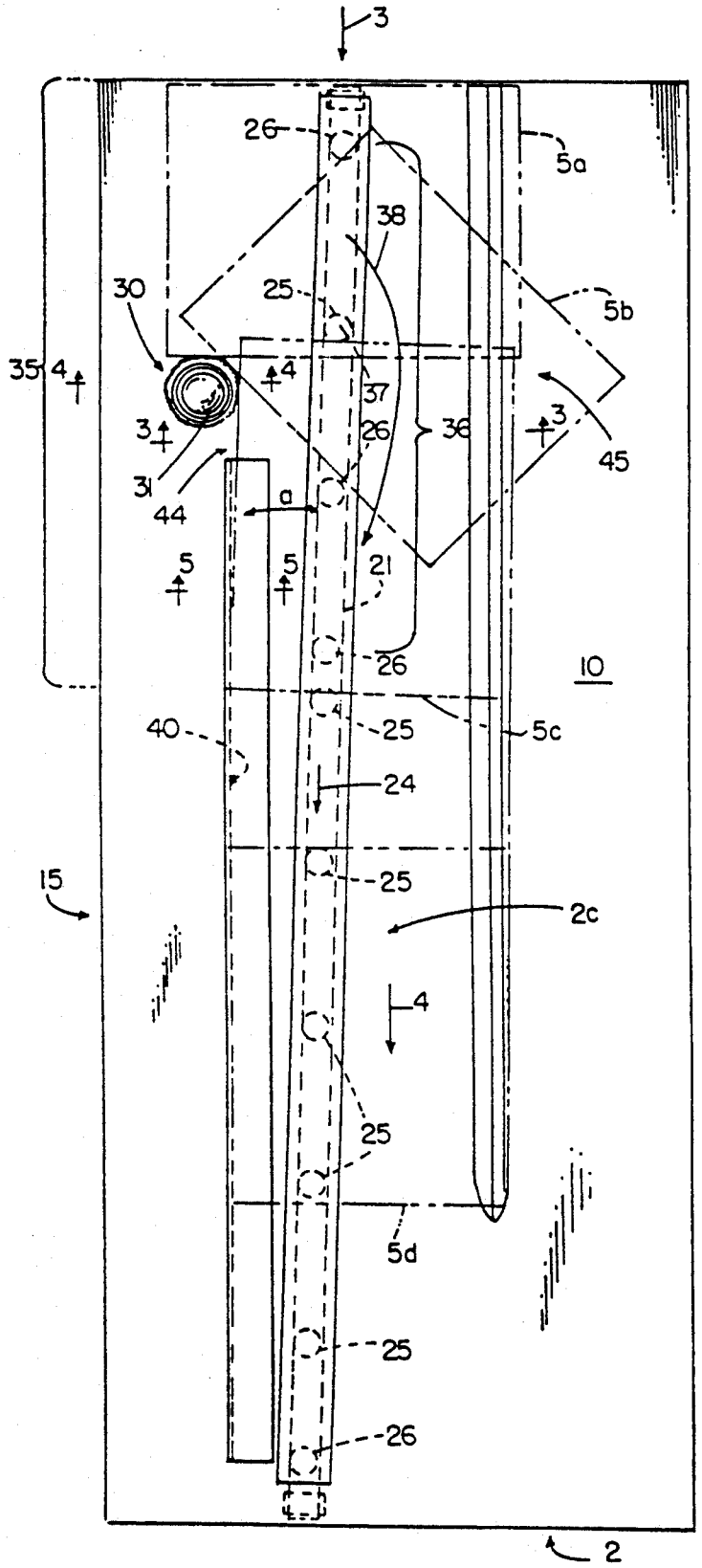
FIG. 1 is a plan view of one embodiment of the apparatus of the invention.
Figures 2, 10:
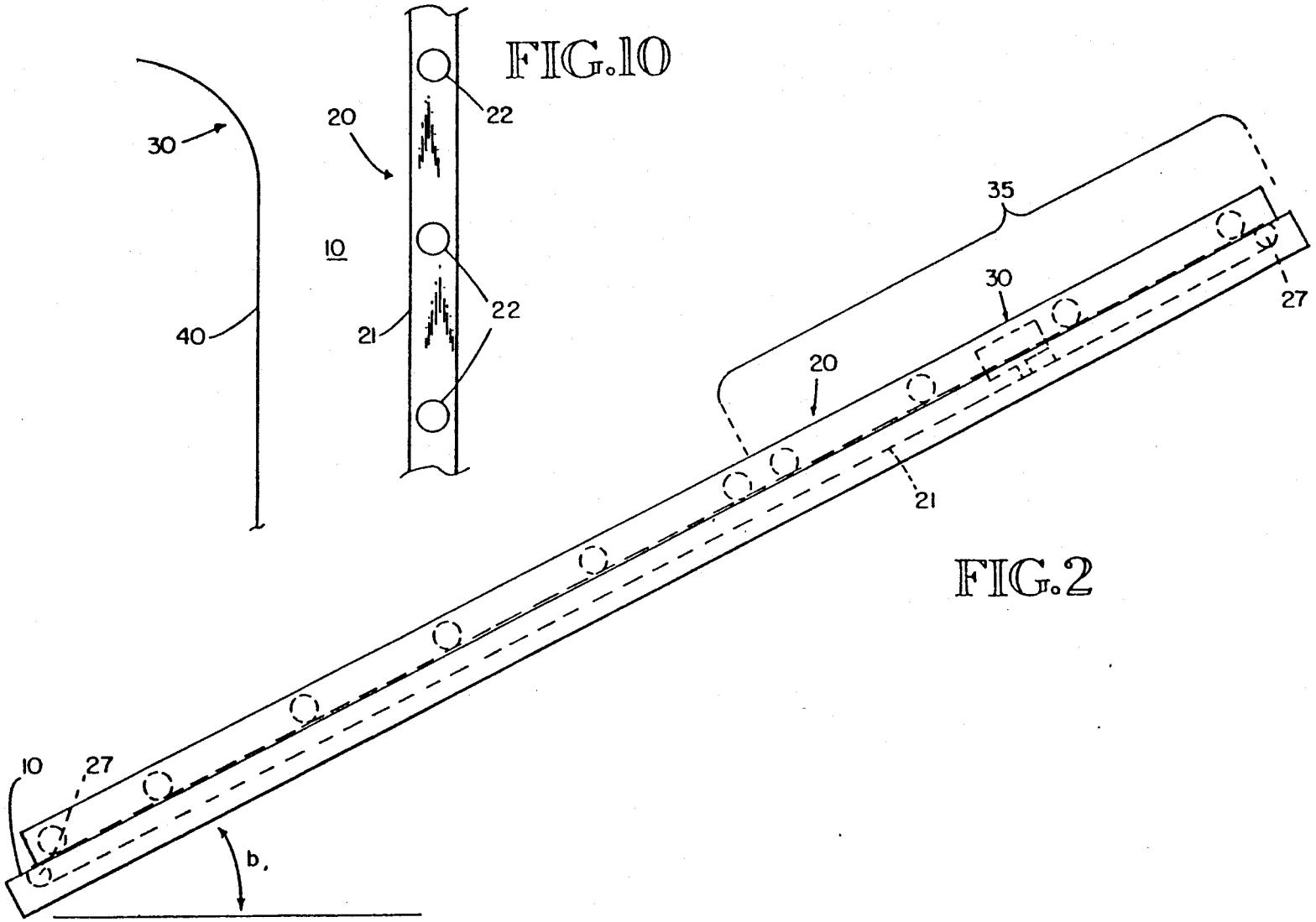
FIG. 2 is a side elevation of the apparatus shown in FIG. 1 displaying the angle "b" of the apparatus with respect to the horizontal.
FIG. 10 is a schematic of an alternate embodiment of the invention.

Referring now to the drawings wherein like numbers indicate like parts the invention is further and more particularly described. In FIGS. 1 and 2 is shown a first embodiment of the apparatus of the invention. Reference to details may be had as well in FIGS. 3, 4, and 5. Paper rotation table 15 is basically comprised of a substantially planar sheet support surface 10, paper drive 20, pivot 30, and registration edge 40. Sheet support surface 10 may be any relatively flat surface, or combination of surfaces along which a sheet of paper 5 may be urged at high speed without deterioration of print quality or surface finish of the sheet. Support surface 10 may be acceptibly fashioned from any durable sheet stock such as aluminum or steel and assembled in any well known manner which will occur to those skilled in the art. In preferred embodiments, a medium gauge steel sheet stock commonly used for fabrication purposes in the art is employed with a powder epoxy finish. This finish provides great long term durability and smoothness to support surface 10 while at the same time minimizing the creation of static electricity in the transport of the paper sheet. Other surface finishes may be employed to advantage as well, such as hard anodize, and others which will occur to those skilled in the art.

While a completely flat utterly planar surface will serve quite well over most of sheet support surface 10 for the transport of paper sheets therealong, and will even serve adequately within the spin station 35, which is a defined region of the overall support surface 10 within which the actual rotation of each paper sheet takes place, if has been experimentally determined that sheet rotation is facilitated by the presence of a small amount of air underneath the sheet while the sheet is subject to rotational forces in the spin station 35. It does not make very much difference how this air is introduced underneath the sheet, and can as well be introduced by air jets located in the sheet support surface 10 within spin station 35, where air is an integral part of some other portion of the paper handling system and therefore conveniently available. However, for simplicity a height differential "h" somewhere along support surface 10, preferably 8 to 8½ inches laterally from registration edge 40, to match the commonly available paper widths, and having the form of a raised ridge 45, may be made in sheet support surface 10. Thus as sheet 5 enters spin station 35 and takes the position shown generally at 5A and is rotated through the positions shown at 5B and 5C, a portion of the sheet 5 is raised above the rest of sheet support surface 10 by height differential "h". In preferred embodiments "h" may range from 0.05 inches to 0.15 inches, with "h" values in the middle of that range preferred most of all. Alternate means of establishing the height differential "h" are further described below with reference to FIGS. 6 and 11. An example of a sheet support surface 10 having more than one plane may be seen in FIG. 7, further described below.

Figure 11:
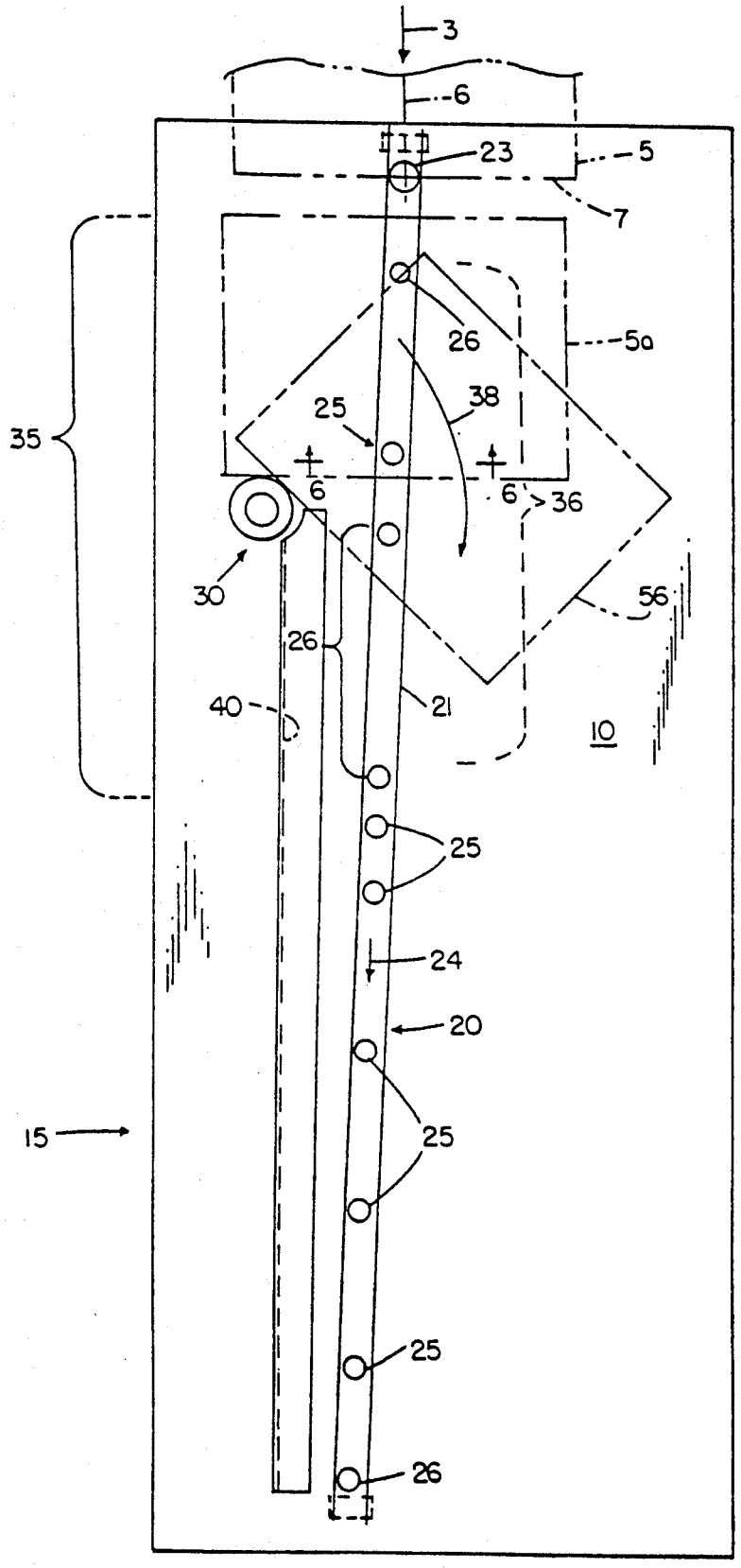
FIG. 11 is a plan view of a modified embodiment of the apparatus of FIG. 1.

Paper drive 20 may be, depending upon the particular embodiment chosen, either conceptually or actually divided into two or more drive sections. A portion of paper drive 20 lying in the region defined as spin station 35 is generally referred to as spin drive 36. Any portion of paper drive 20 up-path of spin station 35, such as is shown in FIG. 11 and further described herein, is referred to as the entry drive and the remainder of paper drive 20 downpath of spin station 35 can be thought of as the exit drive. In one embodiment further described below and illustrated in FIGS. 7–9, paper drive 20 is physically divided into two separate drives as suggested above.

Figure 7:
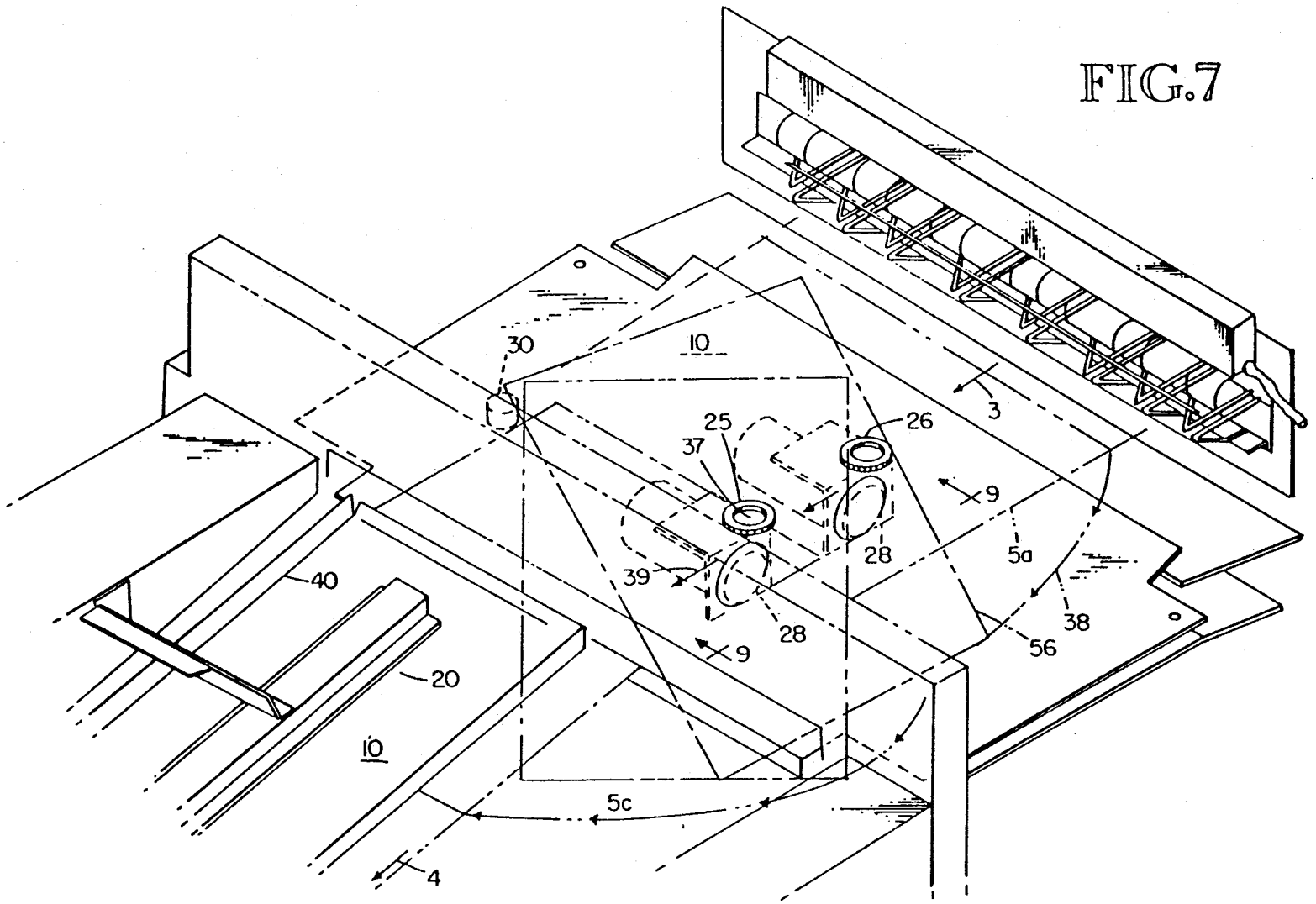
FIG. 7 is an isometric view of an alternate embodiment of the invention.
Figure 8:
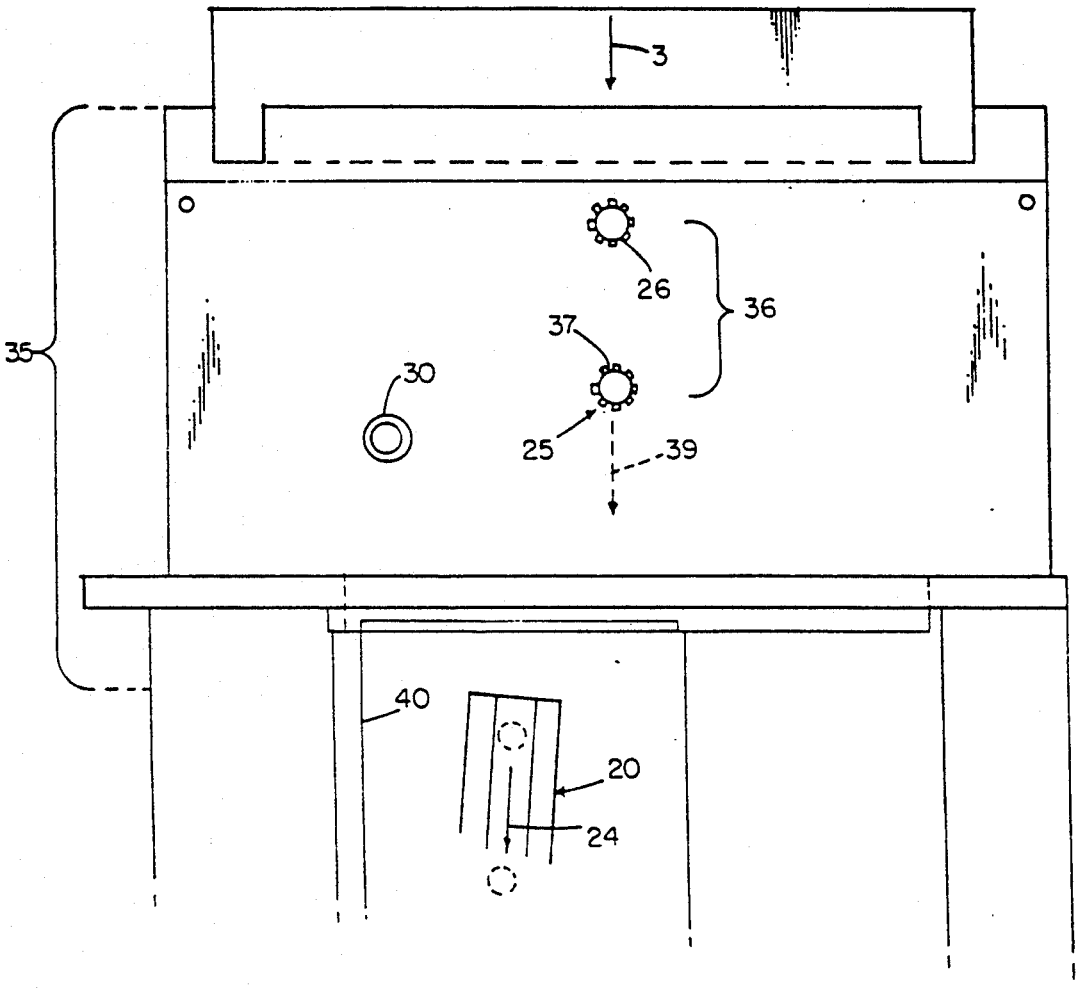
FIG. 8 is a plan view of the apparatus of FIG. 7.
Figure 9:
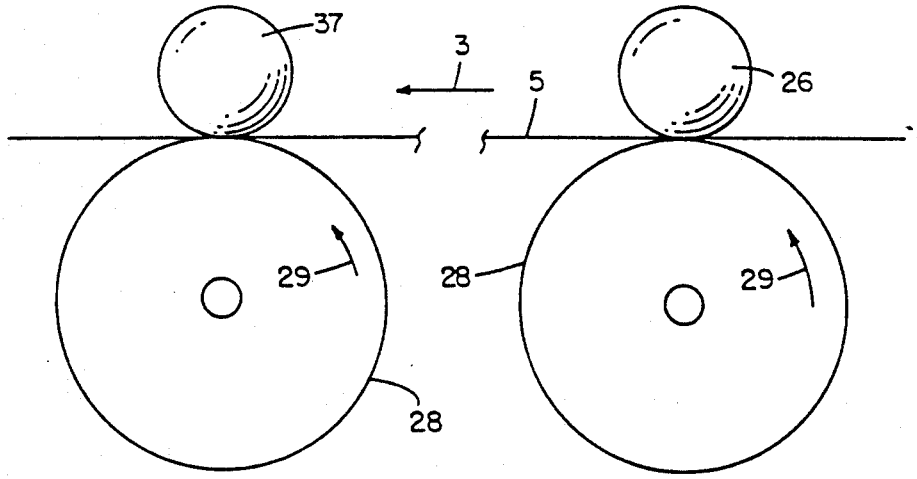
FIG. 9 is a partial side elevation taken along line 9—9 of FIG. 7 (showing only the ball and drive wheel combinations in schematic).

In preferred embodiments, paper drive 20 is a single integral structure as shown in FIGS. 1 and 11 and comprises a narrow belt 21 driven on two rollers 27 (roller motive power not shown and) a generally linear array of balls driven by belt 21, with these driven balls contained within a conventional structure for retaining each of the balls in a relatively rigid relationship with respect to the support surface 10 and the position of belt 21. The roller mounts, motor mounts, and ball frame mountings are not shown in the drawings for the sake of clarity but are all attached to the structure of support surface 10 in ways which will occur to those skilled in the art. By way of illustration, these cylindrical ball holders, of conventional design, are shown in cross-section in FIGS. 3 and 6 shown surrounding spin drive ball 37, and this illustration is typical for each of the balls contained within paper drive 20. Alternatives to belt driven paper drives such as those shown in FIGS. 1 and 11 are illustrated in FIGS. 7–9 and further described below.

In preferred embodiments, the driven balls of paper drive 20 are of at least two types: primary driven balls 25 and secondary driven balls 26. Primary driven balls 25 are heavier than secondary driven balls 26 for reasons which are further detailed below. In general, the appropriate weight ratio between primary driven balls and secondary driven balls may be obtained while at the same time obtaining a sufficient gravitational force for each of the balls against the belt surface in a direction normal to the belt surface, by using steel ball bearings for the primary driven balls 25. A ball bearing in the range of 20 millimeters in diameter has been found to work well as a general use primary drive ball 25. However, other primary drive ball compositions including hollow balls, and weighted, filled balls, and balls composed of substances other than steel, will occur to those skilled in the art and may be used interchangeably with the steel balls disclosed herein without departure from the scope of the invention. Secondary driven balls 26 may be comprised of any relatively durable, appropriately lighter material (the degree of ratio of weight of secondary driven ball to primary driven ball is further described below), and may be selected from any one or more of a group of plastics commonly used to make roller balls, including but not limited to nylon in any of its commercial derivations or TEFLON® OR DELRIN® brand polymers. In preferred embodiments secondary drive balls 26 are comprised of DELRIN® because DELRIN® type balls are generally inert to moisture and therefore will not swell or shrink with changes in ambient room humidity, as will many types of nylon-type balls. However, it is believed that a fiberglass-filled type of nylon ball will be sufficiently moisture resistant and possess appropriate weight density characteristics to be substituted for the preferred DELRIN® balls.

In preferred embodiments rotation table 15 is generally disposed at an angle "b" to the horizontal, both in order to shorten the footprint of the apparatus in applications where linear space is at a premium in paper handling systems, and to provide an additional gravitational inducement to the movement of paper sheet 5 along its various paper movement paths from one end of the apparatus to the other. It has been found that an angle for "b" in the range of 36 degrees to 38 degrees has worked very well, but it is believed that other angles from 0 degrees to nearly verticle would also work, subject to the discussion of gravitational force of the ball upon the belt, or other drive means, normal to the surface of the belt or drive means.

The high speed movement of relatively low mass paper sheet products may be easily effected with relatively small movement forces, particularly when those forces are incremental and repeated along the sheet movement path. This required force is even further lessened when the rotational table is inclined as shown in FIG. 2. Thus, it requires only little gravitational force between a driven ball and the drive belt or other drive means to "nip" the leading edge of a sheet and urge it forward along a sheet path. The force required is not negligible, and therefore consideration must be given to a selection of the appropriate force normal to the belt to achieve desired paper movement forces, while stopping short of achieving sufficient normal force to deform the surface of the paper, by bending or smearing or abraiding the surface, or by causing a detioration in the print quality on either side of the paper sheet being transported.

For this and other reasons drive balls are preferable to roller type drives, usually seen in the form of a pair of pinch rollers. Other reasons for the use of driven balls, particularly within the spin drive section of paper drive 20 will be further described below. It will be appreciated then, that the normal force of the weight of a given ball to the drive belt will depend upon the angle of the support, surface and likewise the drive belt surface, to the horizontal. Thus the preferred size of steel ball for primary driven balls 25 is set at 20 millimeters to obtain an experimentally derived optimum normal force while at the same time causing little or no deformation and degradation to the quality of print and surface of paper sheets 5 for the angle of paper rotation table above disclosed, and it is believed steel ball sizes and weight should not vary significantly below that disclosed. However it is believed that weights may vary by as much as +100% without significant damage or deterioration to paper sheets 5. In some applications, such as that illustrated in FIG. 11 and further described below, a steel ball which is approximately twice as heavy as a 20 millimeter steel ball is actually preferred. Depending upon the paper sheet stock being transported and rotated, and upon the desired degree and quality of the paper product as it exits the rotation table 15, heavier balls than the range disclosed above may be employed, but with an expected greater effect on the quality of paper output from table 15. Since flatter table angles "b" will necessarily give rise to greater forces normal to drive belt 21 for a given ball mass, it has been calculated that for a horizontally positioned table 15 a steel ball size of 13/16 inch, rather than 20 millimeters, will provide the minimum needed normal force to belt surface for primary driving purposes.

Primary drive balls 25 are generally preferred to be anywhere from 5 to 7 times heavier than secondary drive balls 26, while heavier drive balls such as those illustrated in FIG. 11 and further described below will be as much as 10 to 14 times heavier than secondary drive balls 26. Virtually all of the urging of the sheet 5 along the various paper paths is done by the primary drive balls 25. The normal force exerted by secondary drive balls 26 on the belt and therefore on the nip through which paper sheet 5 passes is not quite sufficient enough to handle the paper drive function alone. Rather, secondary drive balls serve as intermediate drive balls and guide-type drive balls in ways which will become apparent below. In general, however, secondary drive balls 26 are employed wherever a sheet of paper must be inserted into the paper drive 20 and wherever the paper sheet 5 will be taken up by some other drive means external to the apparatus. For instance in the embodiment shown in FIG. 1 the first and last driven balls in paper drive 20 are secondary drive balls. This facilitates the insertion of sheet 5 beneath drive ball 26 by the exit driving means of the delivering paper handling device at the first end 1 of rotation table 15, and the snatching of sheet 5 from the second end 2 of rotation table 15 by the take up drive means of the receiving paper handling means at end 2 of table 15. This use of secondary drive balls 26 in these two positions eliminates the necessity for coordination of speeds of delivering and receiving external drive means, and prevents damage to the paper sheet, which might otherwise occur if heavier drive balls were used and the drive speeds of all three paper devices were not synchronized.

It has been experimentally determined that drive belts with a "toothed" surface function better in response to the presence of the various silicon oils and printing inks which attend the paper handling process than do flat commonly available urethane-type drive belt surfaces. Foraminous belt materials such as spandex-type belts will function, but the predictability of the absorbtion of the various oils and inks for these types of belts is lower, and absorbtion of oil and ink results in a potentially eratic transfer of rotational momentum to the respective driven ball, which may in turn lead to bouncing of the driven ball where build-up of inks or oils causes significant height differences along the surface of the belt. Various toothed surface belts which will be suitable for many applications and embodiments of the invention are supplied by TexTech Industries Inc., 150 Industrial Park Road, Middleton, Conn., U.S.A. A "Panther L" type belt 1 inch wide has been found to perform satisfactorily with the apparatus, with the disadvantage that the "Panther L" type belt contains a high degree of carbon black and frequently results in slight marking of the surface of the paper sheet exposed to the surface of the belt. Preferred embodiments of the apparatus employ a model "SFT" belt from TexTech to avoid the marking problems attendant with the "Panther L" type belt. The SFT" belt is a standard semi-elastic type belt so that no tension adjustment need be supplied in the apparatus.

Although it is not essential that the various driven balls be precisely and linearly aligned, even where a relatively narrow drive belt 21 is used, preferred embodiments are so aligned. Where multiple driving systems make up paper drive 20 such as, for instance, where a separate belt or roller system is used for an entry drive a separate belt system is used for a spin drive, section, and yet another separate drive means, which might even be a volume air flow sheet transport system, such as that disclosed in co-owned Canadian Patent No. 1,062,646, is used for an exit drive, there may nonetheless be produced an imaginery centerline (which may be mathematically derived from weighted centerline differences) for the portion of paper drive 20 which runs adjacent to registration edge 40. In any case it will be appreciated that an angle "a" may be measured between registration edge 40 and the centerline of the driven balls of paper drive 20, or the imaginary centerline of that portion of paper drive 20 which runs along registration edge 40. This angle "a" may range from 0 degrees to 45 degrees in theory but practical embodiments will use an angle "a" range of 2–3 degrees, with a 2 degree angle preferred for "a" where the rotation table is inclined to the horizontal at 36–38 degrees and the rotation table length is approximately 49 inches. In other embodiments with different table lengths and different "b" angles, other angles "a" may be more appropriate. The proper value for is in each case a practically derived from paper path length, ball weight normal to the belt surface, and various paper surface and print characteristics, which can be derived in other embodiments by persons skilled in the art having an appreciation of the disclosure herein without departure from the scope of the invention. It is surmised, for example, that a 0 "a" angle may be employed to good advantage where paper sheets 5 are to be fed into a downpath paper handling device immediately after rotation of sheet 5 in spin station 35.

Pivot 30 of FIG. 1 may be better described with reference to FIG. 4. Pivot post 31 is a ball bearing mounted capstan on a shaft mounted generally below support surface 10. Pivot post 31 is shaped generally to receive a pivot post cover 32 which may be any hollow cylindrically shaped cover. Pivot post cover 32 is employed to avoid wear caused by repeated paper impacts and abrasion on pivot post 31 which would eventually necessitate the replacement of pivot post 31 or damage to the sheet. In preferred embodiments pivot post cover 32 is a length of disposable resiliently surfaced cardboard tube, such as may be commonly found in use as a paint roller cover. The resilient surface 34 of cover 32 resists wear and abrasion of the paper sheets and tests have shown sheet cycle lives in excess of 500,000 sheets, at which time the cover may simply be removed, reversed, and reinstalled for another life cycle of 500,000 sheets. It has been experimentally found that the rotation action proceeds more smoothly and reliably when pivot 30 is of the freely rotatable type, however other types of pivot 30, such as those disclosed for example in FIGS. 10 and FIGS. 7 and 8, of the non-rotating type may also be employed to good advantage, but with reduced surface life and less efficiency in the rotation operation. Pivot post 31 rotates about an axis 33 which in preferred embodiments is substantially normal to support surface 10 so that the rotational freedom and its contribution to the efficiency of the paper rotation is maximized; however, the angle of axis 33 with respect to support surface 10 has no other significance and pivots 30 or pivot post 31 having other angles with respect to support surface 10 may be employed without departure from the scope of the invention.

In some embodiments such as that depicted schematically in FIG. 10, pivot 30 and registration edge 40 may be integral, such as by fashioning the integral structure from a single metal band. In other embodiments such as those illustrated in FIGS. 1, 7, and 11 pivot 30 will be separated from the upper end 41 of registration edge 40. In a currently preferred embodiment, illustrated in FIG. 11, pivot 30 is positioned to nest along an upper corner of registration edge 40 which is bevelled to cooperate with the free rotation of pivot 30. This positioning has been found to maximize rotational efficiency of sheet 5 while minimizing potential damage to the edge of sheet 5 which comes into contact with pivot 30 and registration edge 40. In general, positions of pivot 30 are preferred which prevent any edge of sheet 5 from coming into contact with the upper end 41 of registration edge 40 and thereby obtaining a knick or fold. However, where potentially damaging contact between an edge of sheet 5 and an upper portion of registration edge 40 are not important, the position of pivot 30 may be varied yet further to positions not illustrated.

Registration edge 40 serves first, within spin station 35 to arrest, or partially arrest, the spinning movement of sheet 5, as for instance illustrated in FIG. 1 at 5C. Registration edge 40 thereafter serves to guide sheet 5 along sheet exit path 4 to the second end 2 of table 15 under the influence of the downpath portion of paper drive 20. Registration edge 40 may be any structure adapted for guiding the sheets over exit path 4 which will occur to those skilled in the art and may extend straight up path into spin station 35, or other relatively low friction arresting means may be employed in combination with a straight lower registration edge. Thus, it is not essential that registration edge 40 be a single straight line structure but may be composed of substructures, whether straight or not, and of different materials. However, in a preferred embodiment a simple structure consists of registration member 42 shown in FIG. 5 which is formed of a simple sheet metal bend to have a narrow fold, the inner surface of which forms registration edge 40. Registration member 42 is then attached to sheet support surface 10. It is preferred that registration edge 40 be contained within a relatively narrow fold in registration member 42 in order to help prevent edge curl-up as sheet 5 impacts upon and then slides along registration edge 40. In general a preferred set-up of registration edge 40 with respect to pivot 30 is achieved when edge 7 of sheet 5 strikes registration edge 40 along substantially the entirely of edge 7 of sheet 5.

In operation, a paper sheet 5 enters the apparatus along sheet entry path 3 in the direction indicated by the arrow at a first end 1 of paper rotation table 15. Sheet 5 is thrust under secondary drive ball 26 at the receiving end of spin station 35, and is thence urged along gently under the nip of secondary driven ball 26 and belt 21 in the belt direction 24 where it is caught under the nip of primary drive ball 25 and then driven to the position indicated generally at 5A. Primary drive ball 25 in spin station 35 is also referred to as spin drive ball 37. Because the movement of sheet 5 is partially retarded by contact of the leading edge 7 (shown in FIG. 11) of sheet 5 with the outer surface of pivot 30, spin drive ball 37 begins to move sheet 5 along spin path 38 into a position generally shown at 5B. By this time in the embodiment illustrated in FIG. 1. a portion of the edge of sheet 5 has been raised above support surface 10 by ridge 45, thus facilitating rapid rotation of sheet 5. At the position generally shown at 5B, sheet 5 encounters within spin station 35 a next driven ball in the spin drive portion of paper drive 20. This ball is a secondary drive ball 26 and as such yields with only slight resistance to the insertion of sheet 5 beneath the nip of secondary ball 26 and belt 21. Nonetheless this insertion does absorb a portion of the rotational momentum of sheet 5 and serves to partially arrest rotational movement which is completed when edge 7 of sheet 5 impacts upon registration edge 40. In some applications, due to weight of sheet 5, or other factors, a significant enough amount of rotational momentum is yielded in this sheet contact with secondary ball 26 to significantly interfere with the completion of the paper rotation process. For these applications, the embodiment illustrated in FIG. 11 is preferred where the secondary drive ball 26 immediately down path of spin drive ball 37 is moved closer to spin drive ball 37 thus reducing the apparent moment arm of resistance sensed by rotation sheet 5. If sheet 5 is of one of the longer lengths anticipated for use in the apparatus, the completion of its rotation will put it generally in a position illustrated at 5C, having slid under yet a second secondary driven ball 26. Shorter lengths of paper will usually avoid sliding under this second secondary drive ball within the spin drive section 36 of paper drive 20. At this point sheet 5 has completed its rotation in spin station 35 and thereafter under the gentle urging of one or both of secondary driven balls 26 in spin station 35 encounters primary driving ball 25 and the further succession of primary driven balls 25 through to the end of exit path 4, where sheet 5 is yielded up to the drive system of the receiving paper handling device as described above.

FIG. 3 illustrates in cross-section the raising of an edge of sheet 5 by ridge 45 within spin station 35. While sheet 5 is being rotated about pivot 30 under the influence of spin drive ball 37 and belt 21 on roller 27, sheet 5 is generally disposed coplanarly along support surface 10. However at ridge points 46 along ridge 45 sheet 5 is raised a distance "h" above sheet support surface 10 thus creating a cushion of air beneath sheet 5 extending over a portion of sheet 5 which facilitates the smooth and rapid rotation of sheet 5 about pivot 30. Alternatively, in FIG. 6 (a detail from FIG. 11) no ridge is employed; rather, height differential "h" above support surface 10 is created by mounting belt rollers 27 and belt 21 to have an upper surface, at least within spin station 35 which is higher than the surrounding support surface 10. Thus as sheet 5 is caught between the nip of spin drive 37 and belt 21, sheet 5 is raised a distance "h" above sheet support surface 10 to create an air cushion beneath a portion of sheet 5 with the benefits similar to those described above with reference to FIG. 3.

In FIG. 11 a modified embodiment of the apparatus illustrated in FIG. 1 is shown. When relatively long and/or heavier sheet stocks are delivered horizontally from a paper handling device to the first end 1 of paper rotation table 15 the embodiment illustrated in FIG. 1 will sometimes jam because the relatively stiff entering sheet 5 will actually raise secondary drive ball 26 (FIG. 1) where rotation table 15 is disposed at the "b" angle of 36–38 degrees. A preferred embodiment for a rotation table disposed at that angle, and thereby suited to receive all common weights and lengths of stock without jamming is therefore illustrated in FIG. 11. FIG. 11 has at the first end of rotational table 15 a driven entry ball which is heavier than the other primary drive balls 25 in the rest of paper drive 20. Preferably driven entry ball 23 is a 1 inch steel ball bearing which is approximately twice the weight of the 20 millimeter steel ball bearings used for the rest of primary driven balls 25. All that is required however is that driven entry ball 23 be heavy enough to receive and bring around the corner the edge 7 of sheet 5 as it is delivered from the paper handling device at the first end of the apparatus. Driven entry ball 23 then forcefully urges sheet 5 along sheet entry path 3 to the position generally illustrated at 5A which is generally similar to the corresponding position 5A shown in FIG. 1, with the exception hat primary drive ball 25 in spin station 35 and forming part of spin drive 36 is also a larger 1 inch steel ball bearing serving as spin drive ball 37. It has been found that this heavier spin drive ball will better serve the paper rotation function under most circumstances. Again, the selection of the size and weight of spin drive ball 37 as well as the other primary drive balls 25 is dependent upon factors and circumstances discussed above.

A further difference between the embodiment shown in FIG. 11 and that shown in FIG. 1 lies in the positioning of the next two secondary drive balls 26 of spin drive 36 in spin station 35 and the position of pivot 30 with respect to registration edge 40, already discussed above. As discussed above the first of two secondary drive balls 26 is placed closer to spin drive ball 37 to reduce the apparent moment arm resistance of secondary drive ball 26 to sheet 5 as it passes from position 5A through position 5B. A second secondary drive ball 26 in spin drive 36 is positioned to receive only the longer lengths of paper which will be rotated on table 15.

In FIG. 10 a general schematic illustration of the apparatus of the invention is described. The basic elements of the invention comprise support surface 10, paper drive 20, pivot 30, and registration edge 40. In this schematic pivot 30 and registration edge 40 are integral as an illustration of the range of possible of the arrangement for these two components of the apparatus of the invention. Paper drive 20 is comprised of belt 21 and driven balls 22, which in the most basic of embodiments are not differentiated as between primary drive balls and secondary drive balls.

In FIGS. 7-9 an alternative embodiment of the apparatus of the invention is illustrated differing from the previously described embodiments primarily in having multiple planar surfaces comprising support surface 10, and having multiple paper drives comprising paper drive 20. In addition, two different means of driving the spinning balls are illustrated. Support surface 10 is relatively horizontal at the point at which sheet 5 enters the apparatus along sheet entry path 3 to immediately enter spin station 35. Sheet 5 is partially retarded by pivot 30 and spun by spin drive ball 37 under the influence of spin drive ball 37 and drive wheel 28. Sheet 5 moves through spin station 35 through positions 5A, 5B, and 5C in the general spin drive direction 39, although the paper appears to describe the arc in spin path 38. In fact it has been noted that as a sheet 5 moves through positions 5A, 5B, and 5C the actual direction of arrow 39 varies slightly from that shown in dotted lines in FIG. 8. Arrow 39 in FIG. 8 is therefore believed to be the resultant general spin drive direction, and may be thought of as a second direction of movement, as opposed to the first direction of movement of sheet 5 along sheet entry path 3 and the third direction of movement of sheet 5 along sheet exit path 4. As sheet 5 enters spin station 35 along sheet entry path 3, it is pivoted by spin drive ball 37 about pivot 30. By means of a guide, not illustrated, sheet 5 is caused to slide under paper drive 20 along the angled portion of support surface 10 to thence make contact with registration edge 40. In this embodiment paper drive 20 actually comprises two different drive sections. The lower section on the angled portion of the apparatus is substantially the same as the belt and ball type drive illustrated and discussed with references to FIGS. 1 and 11. On the upper horizontal portion of the apparatus in the spin station a roller and ball type drive is employed as may be more particularly seen in FIG. 9. Drive wheels 28 spin a secondary drive ball 26 and a spin drive ball 37 in the directions shown by rotational arrows 29 to move sheet 5 along the direction of sheet entry path 3.

In compliance with the statute, the invention has been described in language more or less specific as to structural features. It is to be understood, however, that the invention is not limited to the specific features shown, since the means and construction shown comprise preferred forms of putting the invention into effect. The invention is, therefore, claimed in any of its forms or modifications within the legitimate and valid scope of the appended claims, appropriately interpreted in accordance with the doctrine of equivalents.

INDUSTRIAL APPLICABILITY

The invention will be useful throughout the business community wherever large quantities of sheet stock paper must be handled, as in high-speed duplicating or printing and the sorting and collating of transported sheets of paper. The invention will serve as a highly functional linkage between two different paper handling devices wherever there is a need for rotation of the transported sheets between one device and another in a paper handling system. The invention is able to handle greater sheet transport rates with little or no interference with the quality and integrity of the paper sheets and, because of simplicity of design and construction much lower maintenance and down time. Individual parts of the apparatus of the invention are fashioned from durable materials for long use cycles between routine maintenance. The apparatus of the invention may readily be adapted to suit existing, or yet to be developed, paper handling devices in the paper handling industry.

I claim:

1. A method of rotating a moving sheet of paper through a predetermined arc comprising the steps of:

(a) imparting a first linear movement to said sheet along a support surface toward a spin station located along said support surface;

(b) imparting rotational movement to said sheet within said spin station along a spin path by retarding said linear movement at an off-center point along a leading edge of said sheet by striking a rotatable pivot post while concurrently imparting forward movement to said sheet as said sheet moves through said spin station; and (c) arresting said rotational movement after said sheet rotates through said predetermined arc, while simultaneously imparting a second linear movement to said sheet urging it along said support surface away from said spin station.

2. The method of claim 1, wherein the step of imparting said first linear movement to said sheet is accomplished by passing said sheet between a nip formed by a belt and a ball driven upon that belt.

3. The method of claim 1, wherein the step of arresting said rotational movement is partially or completely accomplished by placing a registration edge in said spin path at said predetermined degree of sheet rotational arc.

4. The method of claim 1, wherein the step of imparting said second linear movement to said sheet is accomplished by passing said sheet between a nip formed by a belt and a ball driven upon that belt.

5. The method of claim 2, including the step of raising said sheet slightly above the support surface in the spin station due to said belt being spaced a sufficient distance above said support surface thereby forming an air cushion between said sheet and said support surface within the spin station.

6. The method of claim 3, wherein the step of arresting said rotational movement includes passing said sheet between a nip formed by a guide belt and a ball driven upon the belt thereby slowing the rotational movement of the sheet.

7. The method of claim 1, wherein the step of imparting first and second linear movement to said sheet includes passing said sheet through a nip formed by a moving belt and at least one primary driven ball riding upon said belt, and said step of arresting said rotational movement includes slowing the rotational movement of the sheet by first passing said sheet between a nip formed by said belt and a secondary driven ball, said secondary driven ball being lighter than said primary driven ball.

8. The method of claim 1, including the further step of moving an edge of said sheet of paper into contact with a registration edge including the step of passing said sheet through a plurality of nips formed between a moving belt and a plurality of balls in contact therewith, then moving said sheet into contact with said registration edge by angling said moving belt towards said registration edge in a downstream direction.

* * * * *